US007104084B2

(12) United States Patent
Park et al.

(10) Patent No.: US 7,104,084 B2
(45) Date of Patent: Sep. 12, 2006

(54) HEAT PUMP AND STRUCTURE OF EXTRACTION HEAT EXCHANGER THEREOF

(75) Inventors: Young Sun Park, Asan-si (KR); Yun Su Lee, Cheonan-si (KR); Sun Sik Kim, Osan-si (KR)

(73) Assignee: Daewoo Electronics Corporation, Seoul (KR)

( * ) Notice: Subject to any disclaimer, the term of this patent is extended or adjusted under 35 U.S.C. 154(b) by 0 days.

(21) Appl. No.: 11/231,951

(22) Filed: Sep. 21, 2005

(65) Prior Publication Data

US 2006/0107682 A1 May 25, 2006

(30) Foreign Application Priority Data

Nov. 24, 2004 (KR) ..... 10-2004-0097165
Dec. 17, 2004 (KR) ..... 10-2004-0108308

(51) Int. Cl.
*F25B 13/00* (2006.01)
*F25B 41/00* (2006.01)

(52) U.S. Cl. ..... 62/324.1; 62/513

(58) Field of Classification Search ..... 62/196.3, 62/197, 324.1, 434, 437, 513
See application file for complete search history.

(56) References Cited

U.S. PATENT DOCUMENTS 4,551,983 A * 11/1985 Atsumi et al. ..... 62/174
5,479,789 A 1/1996 Borten et al.
5,848,537 A * 12/1998 Biancardi et al. ..... 62/324.6

FOREIGN PATENT DOCUMENTS

KR 10-0253846 1/2000
KR 10-0509200 8/2005

* cited by examiner

*Primary Examiner*—Melvin Jones
(74) *Attorney, Agent, or Firm*—Hamre, Schumann, Mueller & Larson, P.C.

(57) ABSTRACT

A heat pump equipped with an extraction heat exchanger includes a compressor sucking low-temperature-and-low-pressure liquid refrigerant, and compressing and discharging the low-temperature-and-low-pressure liquid refrigerant into high-temperature-and-high-pressure liquid refrigerant, a condenser in which air passing therethrough absorbs heat from the liquid refrigerant to liquefy the liquid refrigerant, an evaporator in which refrigerant absorbs heat from indoor air and is evaporated to cool indoor air, a main electronic expansion valve connected between the condenser and the evaporator to decompress the liquid refrigerant liquefied in the condenser such that the decompressed refrigerant is easily evaporated in the evaporator and flows at a predetermined flow rate; and the extraction heat exchanger branching a part of the high-temperature-and-high-pressure liquid refrigerant, and performing and bypassing heat exchange between high-temperature-and-high-pressure super-cooled liquid refrigerant and high-temperature-and-high-pressure refrigerant passing through a heat exchanging refrigerant tube between the condenser and the main electronic expansion valve to an accumulator.

5 Claims, 4 Drawing Sheets

HEAT PUMP AND STRUCTURE OF EXTRACTION HEAT EXCHANGER THEREOF

BACKGROUND OF THE INVENTION

1. Field of the Invention

The present invention relates to a heat pump equipped with an extraction heat exchanger for guaranteeing operational stability and enhancing power efficiency in the cooling mode and for supplementing a heat source in the heating mode such that the coefficient of performance is enhanced and performance in cold climates is improved, using two electronic expansion valves for controlling superheating in the heating mode, for guaranteeing a low temperature heat source, for guiding any increase in evaporation efficiency, a cycle control of the extraction heat exchanger, and relates to the structure of the extraction heat exchanger capable of being applied to the heat pump by considering uniform distribution of refrigerant and pressure decrease to change the number of tubules according to an increase in capacity of the heat pump.

2. Description of the Related Art

Since, according to the conventional art, it is very difficult to guarantee a heat source at a low-temperature side in cold climates, it is difficult to operate the heat pump due to driving loss caused by a high compression ratio and frosting, and an increase in dryness caused by the flashing of refrigerant. Generally, there are various solutions, i.e. in order to overcome the above-described problem, capacity is adjusted by an inverter, an electric heater is equipped, or insufficient heat is supplemented, and in order to overcome the high compression ratio, a two-stage compression structure is employed, or a compressor is non-conventionally machined such that a sub-cooled refrigerant is injected to an intermediate pressure zone in the compressor, and various heat exchangers are employed to improve the operational characteristics in cold climates. However, since the above methods have disadvantages of high costs and complex structure, recently, inverters and electronic expansion valves are employed to precisely adjust superheat imbalances and to increase capacity.

Moreover, although, in the case of employing the inverter, insufficient heat obtained from the low temperature heat source, i.e. short heating capacity is supplemented by increasing the frequency of the inverter in the heating mode, system efficiency is decreased.

In addition, in the heating mode, in the case of supplementing the insufficient heat via the electric heater and the overload operation by the inverter, the efficiency is decreased and a capacity changing device such as the inverter is employed so that manufacturing costs are increased. Moreover, in a conventional economizer, due to inconsistent capacity adjustment, there is the risk of vapor induction and that the superheat unbalance exceeds a predetermined valve so that the compressor may catch fire.

In particular, in a two-stage compression cycle, although two compressors are employed, or one compressor is non-conventionally machined so that the extracted refrigerant undergoes heat exchange and is injected into an intermediate pressure zone between a high pressure zone and a low pressure zone, the mass production of the non-conventional machining compressor cannot be achieved due to the non-conventional machining. Moreover, since, due to tubules, the distribution of the flow rate is not uniform, and generally precise control is very difficult when a solenoid valve is used, it is difficult to maintain uniform operation.

SUMMARY OF THE INVENTION

Therefore, the present invention has been made in view of the above and/or other problems, and it is an object of the present invention to provide a heat pump equipped with an extraction heat exchanger for extracting a part of super-cooled liquid refrigerant from an outlet of a condenser, for obtaining a part of evaporating heat through the extraction heat exchanger so as to reduce load due to the evaporating heat, for increasing intrinsic mass of refrigerant to use a constant-speed compressor, for operating a high efficiency heat pump with excellent heating performance while performing multi-stage compression, and for properly adjusting extracted steam quality with respect to temperature change of outdoor air so that an optimal operation condition can be maintained by the electronic expansion valve based control.

It is another object of the present invention to provide a structure of an extraction heat exchanger of a heat pump employable by changing the number of tubules based on the capacity increase of the heat pump by considering the uniform distribution and pressure decrease of the refrigerant.

In accordance with the present invention, the above and other aspects can be accomplished by the provision of a heat pump equipped with an extraction heat exchanger, including: a compressor for sucking low-temperature-and-low-pressure liquid refrigerant, and compressing and discharging the low-temperature-and-low-pressure liquid refrigerant into high-temperature-and-high-pressure liquid refrigerant; a condenser in which air passing through absorbs heat from the high-temperature-and-high-pressure liquid refrigerant discharged from the compressor to liquefy the high-temperature-and-high-pressure liquid refrigerant; an evaporator in which the refrigerant absorbs heat from indoor air and is evaporated to cool the indoor air; a main electronic expansion valve connected between the condenser and the evaporator to decompress the high-pressure liquid refrigerant liquefied in the condenser such that the decompressed refrigerant is easily evaporated in the evaporator and flows at a predetermined flow rate; and the extraction heat exchanger for branching a part of the high-temperature-and-high-pressure liquid refrigerant discharged from the outlet of the condenser, and performing and bypassing heat exchange between high-temperature-and-high-pressure super-cooled liquid refrigerant and high-temperature-and-high-pressure refrigerant passing through a heat exchanging refrigerant tube between the condenser and the main electronic expansion valve to an accumulator.

The extraction heat exchanger includes an economizer which the heat exchanging refrigerant tube penetrates and through with the high-temperature-and-high-pressure super-cooled liquid refrigerant flows, a first branch tube connected to a side of the economizer and branched from the heat exchanging refrigerant tube, a second branch tube connected to the other side of the economizer to be joined with a refrigerant tub between the evaporator and the accumulator, and an injection expansion valve installed in the first branch tube to expand a part of the branched high-temperature-and-high-pressure super-cooled liquid refrigerant into a low-pressure refrigerant.

The heat exchanging refrigerant tube is comprised of a serpentine capillary tube such that the heat exchanging surface is increased in the economizer.

In a heat pump equipped with the extraction heat exchanger comprising a compressor, a condenser, an evaporator, a main electronic expansion valve, and the extraction heat exchanger for branching a part of the high-temperature-and-high-pressure liquid refrigerant discharged from the outlet of the condenser, and performing and bypassing heat exchange between high-temperature-and-high-pressure super-cooled liquid refrigerant and high-temperature-and-high-pressure refrigerant passing through a heat exchanging refrigerant tube between the condenser and the main electronic expansion valve to an accumulator, the structure of the extraction heat exchanger includes a body having a hollow cylindrical shape with opened sides, and a super-cooled liquid refrigerant inlet and outlet oppositely formed at sides thereof such the branched refrigerant passes through the inside of the body, a pair of headers respectively coupled with ends of the body, and having an end through which refrigerant enters and exits and a plurality of connection holes formed at the other end thereof, and a plurality of tubules coupled with the headers by being inserted into the connection holes of a pair of headers such that refrigerant discharged from the condenser and entering one of the headers is distributed uniformly and undergoes heat exchange and is discharged to the evaporator through the rest of the headers.

Preferably, the tubules take the form of a multiple-pipe heat exchanger.

According to the heat pump equipped with an extraction heat exchanger of the present invention, in order to guaranteeing a heat source in cold climates like the Achilles' tendon, a part of the super-cooled liquid refrigerant (about 20% to 35% intrinsic mass) is extracted. At that time, the quantity of the extracted refrigerant is adjusted according to low temperature conditions (outdoor air temperature) using the extraction electronic expansion valve to evaporate the supercooled liquid refrigerant in the extraction heat exchanger. The extracted refrigerant is transmitted to the accumulator disposed in front of the compressor, and the rest of the super-cooled liquid refrigerant undergoes heat exchange between the rest of the supercooled liquid refrigerant and the extracted refrigerant so that the refrigerant is further super-cooled and decompressed. The refrigerant is expanded in the main electronic expansion valve and enters an outdoor unit (evaporator). The refrigerant is evaporated in the outdoor unit and is mixed with the extracted refrigerant at the inlet of the accumulator so that the quantity of obtained heat by the evaporator in the heating mode can be reduced by 20% to 35%. Super-cooling is developed so that the quantity of generated flash gas of refrigerant entering the evaporator can be reduced.

BRIEF DESCRIPTION OF THE DRAWINGS

These and/or other aspects and advantages of the present invention will become apparent and more readily appreciated from the following description of the embodiments, taken in conjunction with the accompanying drawings, in which.

DESCRIPTION OF THE PREFERRED EMBODIMENTS

Hereinafter, the preferred embodiments of a heat pump air conditioner according to the present invention will be described in detail with reference to the accompanying drawings.

Figure 1:
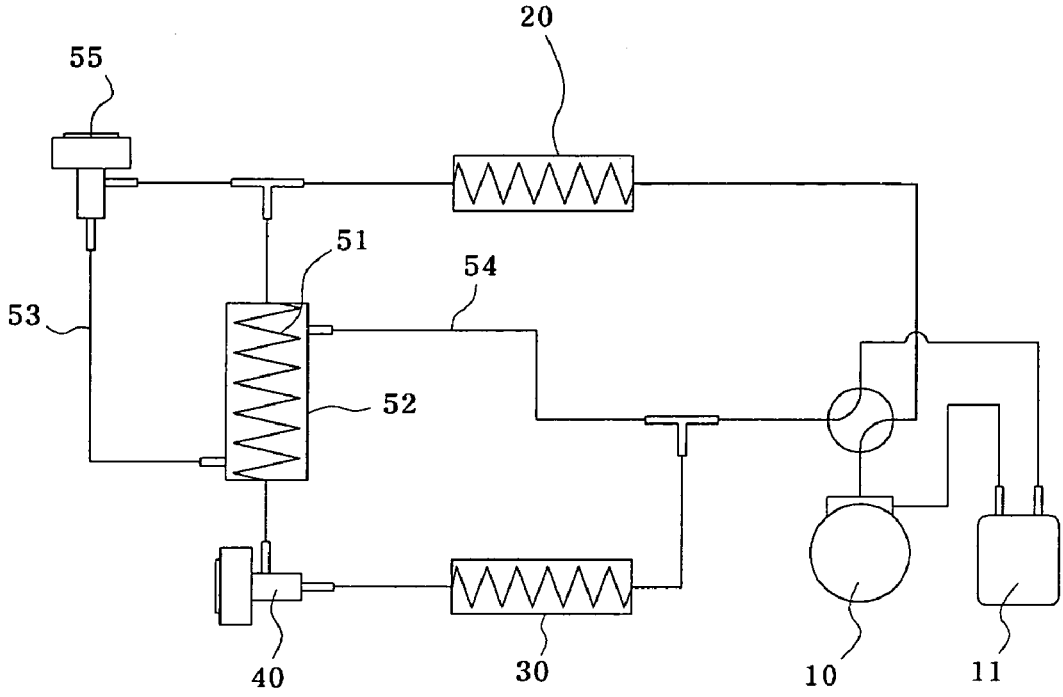
FIG. 1 is a schematic view illustrating a heat pump equipped with an extraction heat exchanger according to a first preferred embodiment of the present invention.
Figure 2:
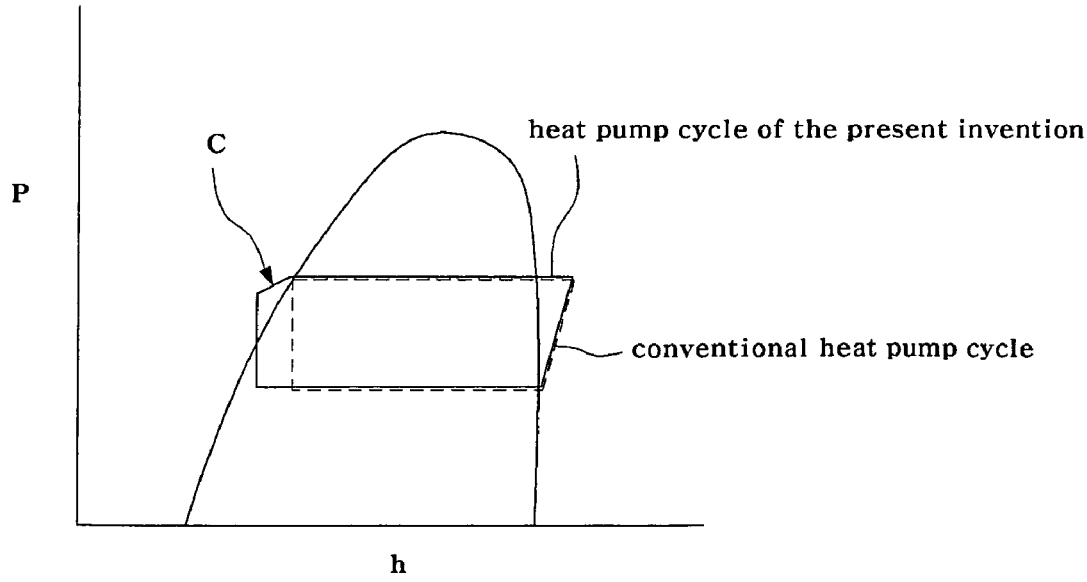
FIG. 2 is a schematic P-h diagram of the heat pump with an extraction heat exchanger according to the first preferred embodiment of the present invention.

FIG. 1 is a schematic view illustrating a heat pump equipped with an extraction heat exchanger according to a first preferred embodiment of the present invention, and FIG. 2 is a schematic P-h diagram of the heat pump with an extraction heat exchanger according to the first preferred embodiment of the present invention. Here, as a preferred embodiment of the heat pump according to the present invention, a refrigerating cycle in the heating mode among cycles of the heat pump will be described.

As shown in the drawing, the heat pump according to the first preferred embodiment of the present invention includes a compressor 10, a condenser 20, an evaporator 30, a main electronic expansion valve 40, and an extraction heat exchanger.

The compressor 10 sucks and compresses low-temperature-and-low-pressure refrigerant into high-temperature-and-high-pressure refrigerant and discharges the high-temperature-and-high-pressure refrigerant.

In the condenser 20, air passing through the condenser 20 absorbs heat from the high-pressure refrigerant discharged by the compressor 10 so that the refrigerant is liquefied.

In the evaporator 30, the refrigerant in the evaporator 30 absorbs heat from the indoor air and is evaporated to cool the indoor air.

The main electronic expansion valve 40 is disposed between the condenser 20 and the evaporator 30, and decompresses the high-pressure refrigerant liquefied by the condenser 20 such that the decompressed refrigerant is easily evaporated in the evaporator 30 and flows at a predetermined flow rate.

The extraction heat exchanger branches a part of high-temperature-and-high-pressure super-cooled liquid refrigerant of the outlet of the condenser 20 to perform heat exchange between the branched part of the high-temperature-and-high-pressure super-cooled liquid refrigerant and high-temperature/high-pressure refrigerant passing through a heat exchanging refrigerant tube 51 and bypasses the same to an accumulator 11.

In addition, the extraction heat exchanger includes an economizer 52 which the heat exchanging refrigerant tube 51 penetrates and the branched high-temperature-and-high-pressure super-cooled liquid refrigerant passes through the heat exchanging refrigerant tube 51, a first branch tube 53 connected to a side of the economizer 52 and branched from the heat exchanging refrigerant tube 51, a second branch tube 54 connected to the other side of the economizer 52 to be joined with a refrigerant tube between the evaporator 30 and the accumulator 11, and an injection electronic expansion valve 55 installed to the first branch tube 53 to expand a part of the branched high-temperature-and-high-pressure super-cooled liquid refrigerant into low-pressure refrigerant.

Preferably, the heat exchanging refrigerant tube 51 includes a serpentine capillary tube such that the heat exchanging surface is increased in the economizer 52.

Operation of the heat pump equipped with an extraction heat exchanger according to the first preferred embodiment of the present invention will be described as follows.

The compressor 10 sucks gaseous refrigerant evaporated in the evaporator 30 and compresses the sucked gaseous refrigerant into high-pressure gaseous refrigerant while maintaining the interior pressure of the evaporator 30 low, then discharges the high-pressure gaseous gas to the condenser 20. After that, air passing through the condenser 20 absorbs heat from the high-pressure gaseous refrigerant discharged from the compressor 10 such that the gaseous refrigerant is liquefied. Meanwhile, heat absorbed in the condenser 20 equals the sum of heat absorbed in the evaporator 30 and heat generated during the compression.

At that time, a part of the high-temperature-and-high-pressure super-cooled liquid refrigerant at the outlet of the condenser 20 is branched to the first branch tube 53, the high-temperature-and-high-pressure liquid refrigerant liquefied in the condenser 20 is decompressed by the injection electronic expansion valve 55 installed to the first branch tube 53 to flow through the inside of the economizer 52. Thus, heat exchange between the super-cooled low-pressure liquid refrigerant decompressed while passing through the injection electronic expansion valve 55 and relatively high-temperature-and-high-pressure refrigerant in the refrigerant tube 51 occurs and the super-cooled low-pressure liquid refrigerant flows to the accumulator 11 via the heat exchanging branch tube 51. At that time, although the degree of super-cooling is increased and a pressure drop occurs while the majority of the condensed liquid refrigerant flowing through the heat exchanging refrigerant tube 51 passes through the economizer 52, the condensed liquid refrigerant is expanded to reach the evaporation pressure by the main electronic expansion valve 40.

Moreover, since a part of the refrigerant entering the evaporator 30 is branched to the accumulator 11 via the first branch tube 53, the economizer 52, and the second branch tube 54, intrinsic mass of the refrigerant entering the evaporator 30 is reduced by the extraction. Thus, the heat absorbing load of the evaporator 30 is reduced, and the reduction of the dryness fraction has the effect of enlarging the size of evaporator 30 by about 30% or more.

In other words, as shown in FIG. 2, a P-h diagram (solid line) of the heat pump according to the preferred embodiment of the present invention has a super-cooling zone C that the P-h diagram (dotted line) of the conventional heat pump does not have. As such, due to the installation of the extraction heat exchanger, super-cooling of the refrigerant entering the evaporator 30 is induced, and the dryness of the refrigerant entering the evaporator 30 is reduced so that evaporation efficiency is enhanced.

As a result, due to the extraction heat exchanger including the first and second branch tubes 53, and 54, the injection electronic expansion valve 55, and the economizer 52, the heat pump according to the first preferred embodiment of the present invention spontaneously adapts to changes in the outdoor conditions by controlling the refrigerant branched by the extraction heat exchanger through the injection electronic expansion valve 55, and exhibits excellent heating performance even during constant-speed single-stage compression in cold climates by the control associated with the main electronic valve 40.

Figure 3:
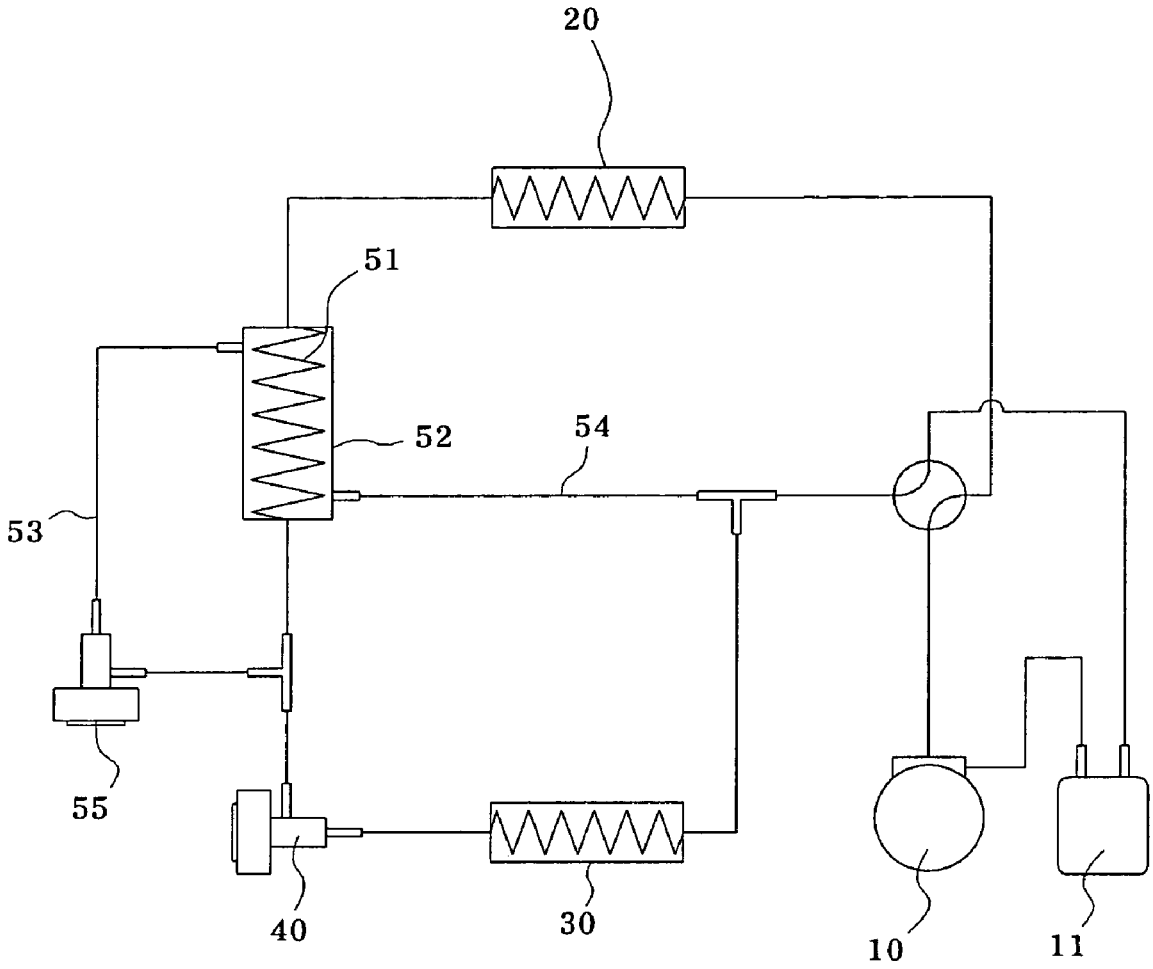
FIG. 3 is a schematic view illustrating a heat pump equipped with an extraction heat exchanger according to a second preferred embodiment of the present invention.

Meanwhile, FIG. 3 is a schematic view illustrating a heat pump equipped with an extraction heat exchanger according to a second preferred embodiment of the present invention, and the heat pump equipped with an extraction heat exchanger according to the second preferred embodiment of the present invention has the same structure as the structure of the heat pump in FIG. 1 except for the position where the super-cooled liquid refrigerant is branched from the condenser 20, i.e. only position change of the first branch tube 53.

In other words, although in the heat pump according to the first preferred embodiment, the high-temperature-and-high-pressure super-cooled liquid refrigerant is branched directly at the outlet of the condenser 20, in the heat pump according to the second preferred embodiment of the present invention, the part of the high-temperature-and-high-pressure super-cooled liquid refrigerant is branched after being discharged from the outlet of the condenser 20 and passing through the heat exchanging refrigerant tube 51, and since the operation and effect of the heat pump according to the second preferred embodiment of the present invention are identical to those of the heat pump according to the first preferred embodiment of the present invention, a description of the operation and effects thereof will be omitted.

Consequently, the heat pumps equipped with an extraction heat exchanger according to the first and second preferred embodiments of the present invention evaporate the part of the high-temperature-and-high-pressure super-cooled liquid refrigerant using the electronic expansion valve and the extraction heat exchanger and reduce the heat-absorbing load. In the heat pumps according to the first and second preferred embodiments of the present invention, since the pressure of the refrigerant entering the evaporator is reduced and the super-cooling becomes stronger, the quantity of generated flash gas is reduced in comparison to a general heat pump, and since the intrinsic mass of the refrigerant entering the evaporator is reduced to as much as the quantity of the extracted intrinsic mass, the refrigerant is easily evaporated. In order to maintain superheat unbalance due to the extracted intrinsic mass, an electronic expansion valve controls superheat unbalance. The extraction heat exchanger is made of tubules and copper pipes. The extraction heat exchanger has a shell and tube shape such that the super-cooled refrigerant flows in the tubules and the copper pipes and the extracted refrigerant expanded in the extraction electronic valve flows through the outside of the tubules and the copper pipes as a counter flow against the extracted refrigerant flowing in the tubules and the copper pipes. When changing capacity of the extraction heat exchanger, the number of the tubules can be increased so that the heat transferring surface area of the extraction heat exchanger and the quantity of refrigerant in the tubes and pipes can be adapted to the changed capacity.

Figure 4:
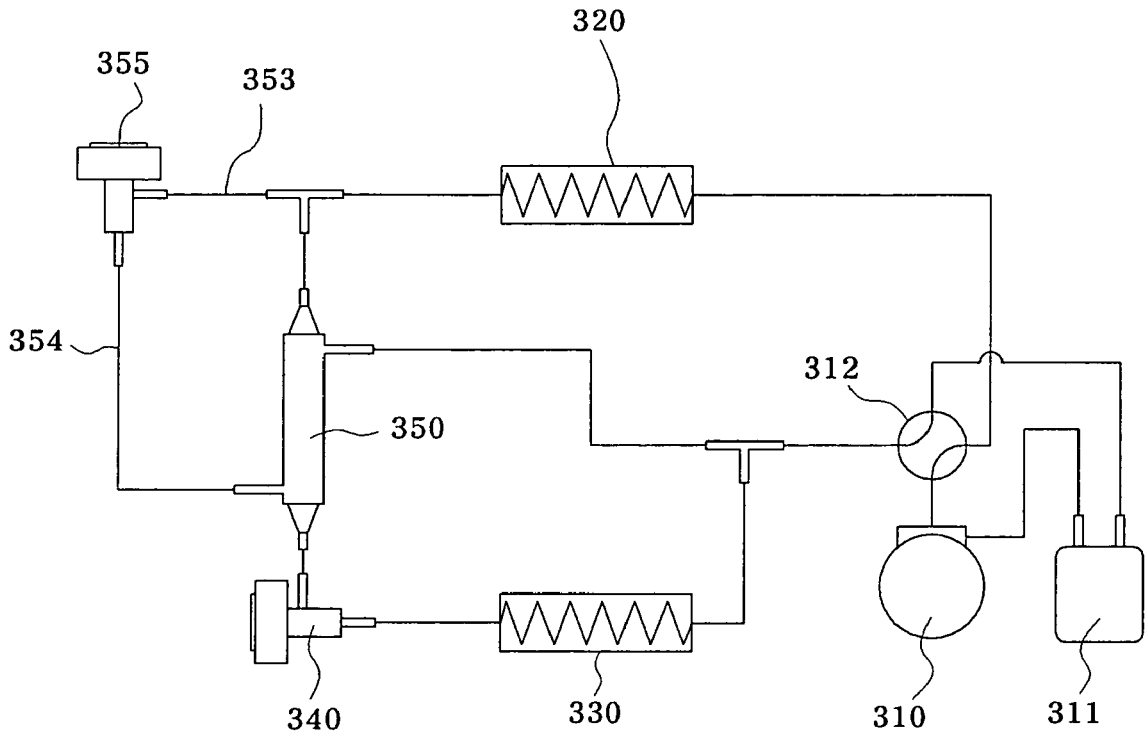
FIG. 4 is a schematic view illustrating a heat pump equipped with an extraction heat exchanger according to a third preferred embodiment of the present invention.
Figure 5:
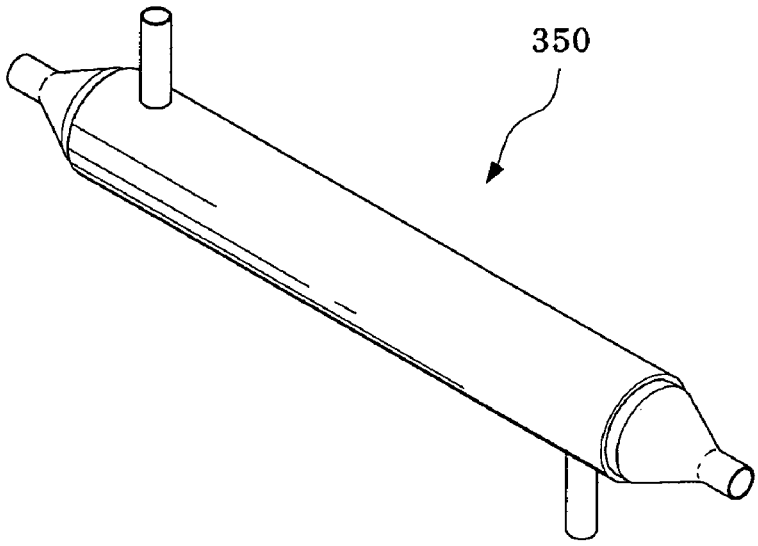
FIG. 5 is a perspective view illustrating the structure of the extraction heat exchanger of the heat pump according to the third preferred embodiment of the present invention.
Figure 6:
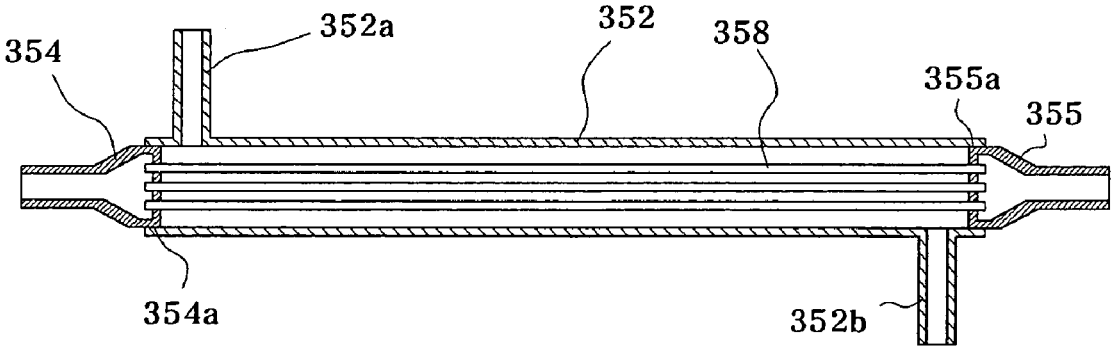
FIG. 6 is a sectional view of the extraction heat exchanger of the heat pump according to the third preferred embodiment of the present invention.

FIG. 4 is a schematic view illustrating a heat pump equipped with an extraction heat exchanger according to a third preferred embodiment of the present invention, FIG. 5 is a perspective view illustrating the stricture of the extraction heat exchanger of the heat pump according to the third preferred embodiment of the present invention, and FIG. 6 is a sectional view of the extraction heat exchanger of the heat pump according to the third preferred embodiment of the present invention.

As shown in the drawings, the heat pump equipped with an extraction heat exchanger according to the third preferred embodiment of the present invention includes a compressor 310, a condenser 320, an evaporator 330, a main electronic expansion valve 340, and an extraction heat exchanger 350. The extraction heat exchanger 350 branches a part of high-temperature-and-high-pressure super-cooled liquid refrigerant discharged from the outlet of the condenser 320, performs heat exchange between the branched high-temperature-and-high-pressure super-cooled liquid refrigerant and high-temperature-and-high-pressure refrigerant passing through refrigerant tubes between the condenser 320 and the main electronic expansion valve 340, and bypasses the heat-exchanged refrigerant to the accumulator 311. The extraction heat exchanger 350 includes a body 352, a pair of headers 354 and 355, and a plurality of tubules 358.

The body 352 has a hollow cylindrical shape having opened sides, and a super-cooled liquid refrigerant inlet 352*a* and a super-cooled liquid refrigerant outlet 352*b* oppositely formed at the sides thereof such the branched refrigerant passes through the inside of the body 352.

The headers 354 and 355 are respectively coupled with the ends of the body 352, and have an end through which refrigerant enters and exits and a plurality of connection holes 54*a* and 55*a* formed at the other end thereof.

The tubules 358 are coupled with the headers 353 and 355 by being inserted into the connection holes 354*a* and 355*a* of a pair of headers 354 and 355 such that refrigerant discharged from the condenser 320 and entering the left header 354 is distributed uniformly, undergoes heat exchange, and is discharged to the evaporator 330 through the right header 355.

Preferably, the tubules are formed in the form of a multiple-pipe heat exchanger.

Operation of the structure of an extraction heat exchanger of a heat pump according to the third preferred embodiment of the present invention will be described as follows.

The majority of super-cooled liquid refrigerant discharged from the outlet of the condenser 320 enters the left header 354, and the entered refrigerant is uniformly distributed through the plural tubules 358. After that, the refrigerant passes the tubules 358, undergoes heat exchange, exits the right header 355, and enters the evaporator 330.

Meanwhile, a part of super-cooled high-temperature-and-high-pressure liquid refrigerant discharged from the outlet of the condenser 320 enters the inlet 352*a*, and undergoes heat exchange between the super-cooled high-temperature-and-high-pressure liquid refrigerant and refrigerant passing through the tubules 358 while the super-cooled high-temperature-and-high-pressure liquid refrigerant passes through the body 352. The super-cooled high-temperature-and-high-pressure liquid refrigerant is discharged to the accumulator 311 through the outlet 352*b*.

As a result, the extraction heat exchanger 350 includes the headers 354 and 355 for inducing the uniform distribution of the refrigerant, and the body 352 and the tubules 358 directly contacting the refrigerant and performing heat exchange. The headers 354 and 355 have a shape for inducing uniform distribution of refrigerant expanded into two-phases. The body 352 and the tubules 358, directly contacting the refrigerant, form a multiple tube heat exchanger such that a 10% to 18% pressure drop occurs in the entire decompression zone, thereby enhancing energy efficiency and heat transfer efficiency.

Meanwhile, when there is a need to increase the heat transfer surface area in proportion to a capacity increase of the heat pump, since the number of tubules 358 is changed and a high algebraic average temperature difference is used, a sufficient quantity of heat transfer can be guaranteed by a small heat transfer surface area, and since the extraction heat exchange is small, it can be conveniently applied to general heat pumps.

As described above, the heat pump, equipped with an extraction heat exchanger, of the present invention controls superheat unbalance in the cooling mode, guarantees a low temperature heat source in the heating mode, and increases evaporation efficiency by using the extraction of super-cooled liquid refrigerant discharged from the outlet of the condenser and the spontaneous control of the quantity of the extracted refrigerant. Moreover, the heat pump of the present invention guarantees operational stability and enhances efficiency of power saving in the cooling mode, and supplements heat source in the heating mode so that coefficient of performance is enhanced and performance in cold climates is improved.

According to the heat pump of the present invention, due to the extraction heat changer and two electronic expansion valves, 20% to 35% of heat load that must be obtained by the conventional evaporator can be reduced. The heat load is obtained from super-cooled liquid refrigerant by the extraction heat exchanger and the extraction electronic expansion valves, so that the heat load obtained in the cold region can be reduced. Since the quantity of generated flash gas in the evaporator is decreased, heat transfer efficiency of the evaporator is increased, and since low pressure is increased, overall efficiency is enhanced. Especially, due to the load reduction of the evaporator, since the temperature difference between the evaporator and outdoor air is decreased, the quantity of frost is reduced in comparison with the conventional heat pump so that enhancement of efficiency can be expected.

According to the heat pump equipped with an extraction heat exchanger of the present invention, the number of tubules can be changed according to the capacity increase of the heat pump by considering the uniform distribution and pressure drop of refrigerant.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A heat pump equipped with an extraction heat exchanger comprising:

a compressor for sucking low-temperature-and-low-pressure liquid refrigerant, and compressing and discharging the low-temperature-and-low-pressure liquid refrigerant into high-temperature-and-high-pressure liquid refrigerant;

a condenser in which air passing therethrough absorbs heat from the high-temperature-and-high-pressure liquid refrigerant discharged from the compressor to liquefy the high-temperature-and-high-pressure liquid refrigerant;

an evaporator in which the refrigerant absorbs heat from indoor air and is evaporated to cool the indoor air;

a main electronic expansion valve connected between the condenser and the evaporator to decompress the high-pressure liquid refrigerant liquefied in the condenser such that the decompressed refrigerant is easily evaporated in the evaporator and flows at a predetermined flow rate; and the extraction heat exchanger for branching a part of the high-temperature-and-high-pressure liquid refrigerant discharged from the outlet of the condenser, performing heat exchange between high-temperature-and-high-pressure super-cooled liquid refrigerant and high-temperature-and-high-pressure refrigerant passing through a heat exchanging refrigerant tube between the condenser and the main electronic expansion valve and bypassing to an accumulator.

2. The heat pump equipped with an extraction heat exchanger as set forth in claim 1, wherein the extraction heat exchanger comprises:

an economizer which the heat exchanging refrigerant tube penetrates and the high-temperature-and-high-pressure super-cooled liquid refrigerant flows in;

a first branch tube connected to a side of the economizer and branched from the heat exchanging refrigerant tube;

a second branch tube connected to the other side of the economizer to be joined with a refrigerant tube between the evaporator and the accumulator; and an injection expansion valve installed in the first branch tube to expand a part of the branched high-temperature-and-high-pressure super-cooled liquid refrigerant into low-pressure refrigerant.

3. The heat pump equipped with an extraction heat exchanger as set forth in claim 1, wherein the heat exchanging refrigerant tube comprises a serpentine capillary tube such that heat exchanging surface is increased in the economizer.

4. A structure of an extraction heat exchange of a heat pump equipped with the extraction heat exchanger comprising a compressor, a condenser, an evaporator, a main electronic expansion valve, and the extraction heat exchanger for branching a part of the high-temperature-and-high-pressure liquid refrigerant discharged from the outlet of the condenser, and performing heat exchange between high-temperature-and-high-pressure super-cooled liquid refrigerant and high-temperature-and-high-pressure refrigerant passing through a heat exchanging refrigerant tube between the condenser and the main electronic expansion valve and bypassing to an accumulator, wherein the extraction heat exchanger comprises:

a body having a hollow cylindrical shape with opened sides, and a super-cooled liquid refrigerant inlet and outlet oppositely formed at sides thereof such the branched refrigerant passes through the inside of the body;

a pair of headers respectively coupled with ends of the body, and having an end through which refrigerant enters and exits and a plurality of connection holes formed at the other end thereof; and a plurality of tubules coupled with the headers by being inserted into the connection holes of a pair of headers such that refrigerant discharged from the condenser and entering one of the headers is distributed uniformly and undergone heat exchange and is discharged to the evaporator through the rest of the headers.

5. The structure of an extraction heat exchange of a heat pump equipped with the extraction heat exchanger as set forth in claim 4, wherein the tubules take the form of a multiple-pipe heat exchanger.

* * * * *